US008266852B2

(12) United States Patent
Samuels

(10) Patent No.: US 8,266,852 B2
(45) Date of Patent: Sep. 18, 2012

(54) METHOD FOR MANUFACTURING A FILLED INSULATED GLASS UNIT AND SUCH A UNIT

(76) Inventor: Diane I. Samuels, Pittsburgh, PA (US)

( * ) Notice: Subject to any disclaimer, the term of this patent is extended or adjusted under 35 U.S.C. 154(b) by 958 days.

(21) Appl. No.: 11/693,389

(22) Filed: Mar. 29, 2007

(65) Prior Publication Data

US 2007/0245686 A1 Oct. 25, 2007

Related U.S. Application Data

(60) Provisional application No. 60/744,044, filed on Mar. 31, 2006.

(51) Int. Cl.
*E06B 3/54* (2006.01)

(52) U.S. Cl. ..... 52/204.593; 52/311.1; 52/786.1; 52/786.13; 428/34

(58) Field of Classification Search ..... 52/204.59, 52/204.593, 786.1, 786.11, 786.13; 428/34
See application file for complete search history.

(56) References Cited

U.S. PATENT DOCUMENTS 999,112 A * 7/1911 Kloster et al. ..... 52/204.59
3,990,201 A * 11/1976 Falbel ..... 52/786.13
4,683,154 A * 7/1987 Benson et al. ..... 428/34
5,156,894 A * 10/1992 Hood et al. ..... 52/786.13
5,657,607 A * 8/1997 Collins et al. ..... 52/786.13
5,902,652 A * 5/1999 Collins et al. ..... 428/34
6,479,112 B1 * 11/2002 Shukuri et al. ..... 52/786.13
2004/0081775 A1 * 4/2004 Martin et al. ..... 428/34

* cited by examiner

*Primary Examiner* — Joshua J Michener
*Assistant Examiner* — Matthew J Smith
(74) *Attorney, Agent, or Firm* — Standley Law Group LLP

(57) ABSTRACT

An ornamental filled glass unit ("FGU") is manufactured by placing a first glass lite in a horizontally supported position and affixing a spacer frame around a periphery of the first surface, providing a space for filling. A first joiner element centered on the first surface, the joiner element having an upward height that slightly exceeds an intended gap between the first lite and a second lite to be placed on the spacer frame. Additional joiner elements may be used, depending upon the area of the first surface. A filler design is built by arranging a plurality of infill elements in the filling space. The second lite is affixed to an adhesive sealant around a top surface of the spacer frame, and to an adhesive on an upwardly-extending surface of each joiner element. The filler design is spatially maintained when the filler space is sealed by the second lite.

14 Claims, 6 Drawing Sheets

METHOD FOR MANUFACTURING A FILLED INSULATED GLASS UNIT AND SUCH A UNIT

CROSS-REFERENCE TO RELATED APPLICATIONS

This application is a non-provisional of U.S. provisional application 60/744,044, filed 31 Mar. 2006, from which a claim of benefit of priority under 35 USC §120 is made and which is incorporated by reference as if fully recited herein.

TECHNICAL FIELD

The inventive embodiments disclosed herein relate to a method for providing patterns in glass by filling a space between opposing lites of glass in a sealed unit with ornamental elements such as glass beads, glass lenses, glass disks, glass rectangles, glass disks, glass mirrors, and custom-cut glass shapes that do not depend from and are not supported by a spacer frame that holds the lites in spaced-apart relationship. Other embodiments would allow for plastic, metal, etc. The invention also encompasses structural units comprising one or more of the filled glass units.

BACKGROUND OF THE INVENTION

As used in this context, and with reference to FIG. 1, an "insulating glass unit" ("IGU"), as is generally known in the prior art, is seen in partial view as being a sealed unit 10 that is fabricated by combining at least two panes 12, 14 (also referred to as "lites") of glass (either monolithic or laminate) in spaced-apart parallel relationship. A continuous spacer 16, shown only along top edge 18 of the panes 12, 14, creates a closed air space 20 that provides improved energy performance when the entire exterior periphery is sealed. Roughly speaking, the air space 20 is a volume generally defined an area of the lites 12, 14 and a thickness of a gap 22 separating the interior surfaces 24, 26 of the respective lites. Exterior surfaces 28, 30 of the respective lites are also shown. Gap 22 is small compared to the height or width of the lites 12, 14, but is on the order of magnitude of the thickness of the lites. Insulating glass units 10 may be configured with a variety of glass pane materials and may often use laminated glass on only the interior pane. If glazing is selected with the laminated glass on the interior surface only, then it is critically important to ensure that the windows are installed in the desired configuration. Accidentally installing the monolithic lite on the interior and the laminated lite on the exterior may create significant hazards to occupants.

In an IGU, the spacer typically contains a desiccant for dehydrating the sealed air space. The air space reduces heat gain and loss, as well as sound transmission, which gives the IGU unit superior thermal performance and acoustical characteristics compared to single glazing. Most commercial windows, curtain walls, and skylights contain IGU units. Most perimeter seals consist of a combination of both a non-curing primary seal material, such as a butyl material, and a cured secondary seal, which is commonly a silicone-based polymer. The quality of the hermetic sealants installed between the glass and the spacers and the quality of the desiccant will, in large part, determine the service life of the IGU.

The glass lites in an IGU have a range of motion determined by the inherent flexibility of the lite and the particulars of the framing. Environmental and structural stresses will cause changes in the gap between the lites, as the lites move relative to each other. Accommodating stress and deflections is a critical part of IGU design. Due to safety and durability concerns, the ASTM has set stringent standards and tests for IGUs used in fixed windows.

It is known in the art to place certain ornamental elements and certain functional elements in the air space. For example, it is well-known to ornamentally simulate mullioned windows by placing a lattice in the air space and it is also known to place blind or shade elements in the air space. These elements are typically dependent from and/or supported by the spacer. This is particularly true in the case of a functional element, such as a blind. As these elements are designed to not be in contact with the internal lite surfaces, the elements may be thought of as being effectively two-dimensional.

While there is clearly a desire to provide an IGU that contains an ornamental arrangement of three-dimensional patterns using numerous, apparently free-floating, components such as beads, lenses, disks and rectangles in a stable arrangement, that is, a filled insulating glass unit ("FGU"), but the known prior art does not provide such a device or a method of fabricating it.

SUMMARY OF THE INVENTION

It is therefore, an advantage of the disclosed embodiments herein to provide such a device and method.

In one embodiment, a method of fabricating a filled insulated glass unit comprises the steps of:

providing a first lite of glass;

placing the first lite in a horizontally supported position, a first surface of the first lite facing upwardly;

affixing a spacer frame around a periphery of the first surface;

affixing a first end of each of at least one joiner elements to the first surface, each joiner extending substantially normal to the first surface, and each joiner element having an upward height that slightly exceeds an intended gap to be formed;

building up a filler design atop the first surface by arranging a plurality of infill elements within the spacer frame;

applying a bead of adhesive sealant around a top surface of the spacer frame;

providing an adhesive on an upwardly-extending second end of each joiner element;

registering a second lite of glass atop the spacer frame and each joiner element, a first surface of the second lite in facing relationship to the first surface of the first lite; and applying pressure to the second lite to sealingly secure it to the spacer frame, forming a filled glass unit with the intended gap between the respective first surfaces;

wherein the infill elements are sized and selected to be maintained in the filler design in the gap when the filled glass unit is turned to a vertical position.

In some of these embodiments, the step of affixing the spacer frame is achieved using a bead of an adhesive sealant.

Some embodiments comprise the further step of removing atmospheric moisture from the filled glass unit by inserting a desiccant material into the unit before the second lite is sealed to the spacer frame.

In some methods, the step of affixing the joiner elements to the first surface of the first lite comprises the steps of centering the first joiner element atop the first surface, and arranging the further joiner elements, if any, in symmetrical sets relative to the first joiner element.

An embodiment of the ornamental filled insulated glass unit comprises a first and a second lite of glass, the respective lites being of substantially identical height and width. A continuous spacer frame is affixed around a periphery of each of the lites to maintain the lites in fixed spaced-apart relationship, providing a gap with a predetermined thickness between the facing inner surfaces of the lites. A first joiner element, having a thickness slightly larger than the thickness of the gap, is positioned in the gap and contacts the respective inner surfaces of the lites at a center point of each. A plurality of infill elements are arranged around the first joiner element in the gap to substantially fill the gap, each of the infill elements having a thickness slightly less than the gap thickness.

Some of these embodiments further comprise a plurality of second joiner elements, arranged in at least one set of symmetrical positions about the first joiner element, each of the second joiner elements having a thickness slightly larger than the gap thickness, positioned in the gap and contacting the respective inner surfaces of the lites.

In some embodiments, each of the joiner elements are affixed to the inner surfaces of the first and second lites by a layer of double-sided bonding tape.

In some embodiments, the joiner elements are visually indistinguishable from the infill elements.

Some embodiments have at least one of the lites comprising laminated glass.

In a yet further embodiment, an ornamental display comprises a plurality of the ornamental filled insulated glass units, maintained in a predetermined spatial arrangement by a framing structure.

BRIEF DESCRIPTION OF THE DRAWINGS

The scope of the claims will be better understood when reference is made to the appended drawings, where identical parts are identified by identical reference numerals and wherein:

DETAILED DESCRIPTION OF AN EXEMPLARY EMBODIMENT

Figure 1:
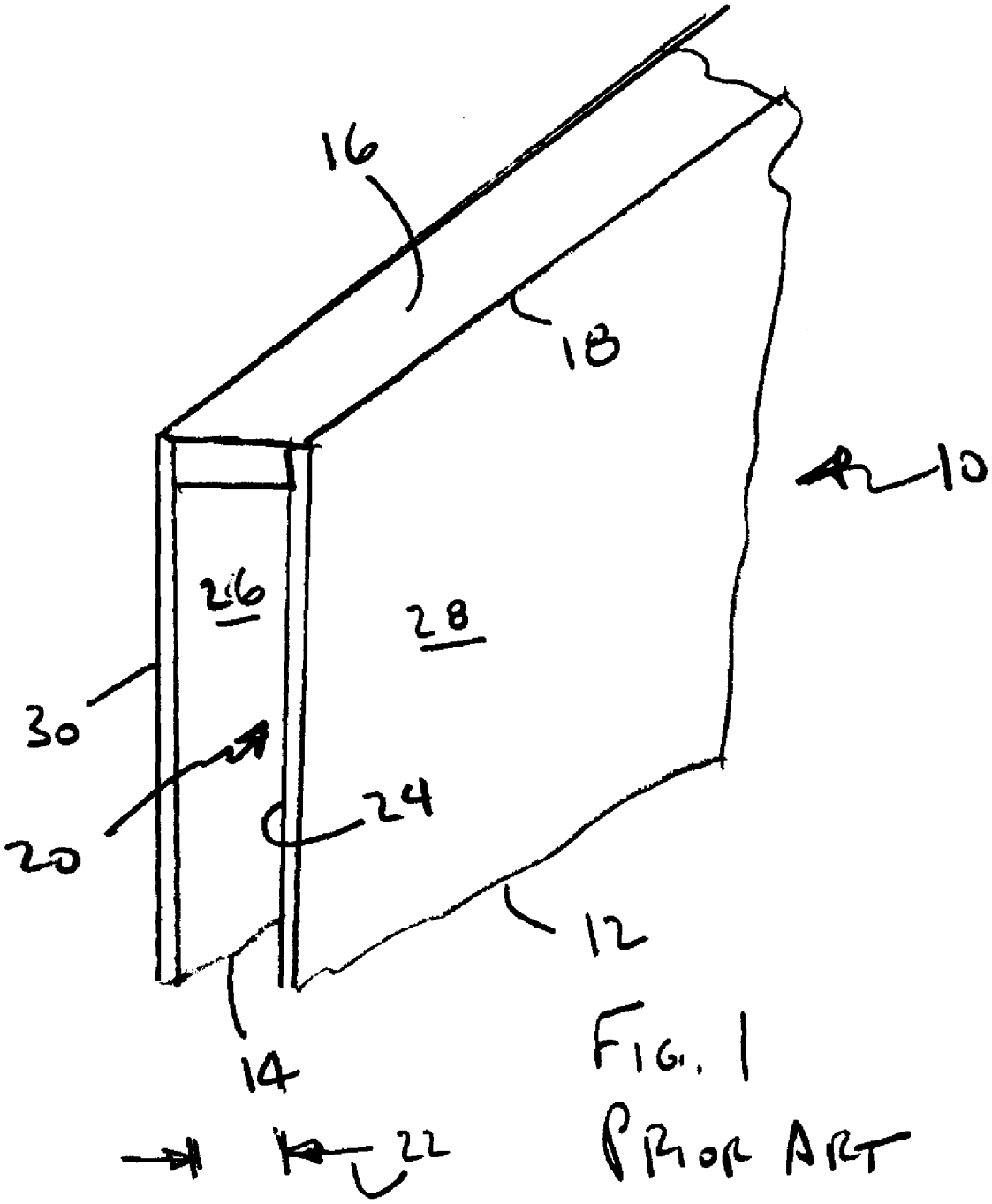
FIG. 1 PRIOR ART
FIG. 1 is a partial perspective view of a insulated glass unit as known in the prior art.

Referring first to FIG. 1, a perspective view of a portion of an IGU as generally known in the prior art is provided to establish a basis for terminology used hereinafter. Detailed description of FIG. 1 is provided above in the "Background" section.

Figure 2:
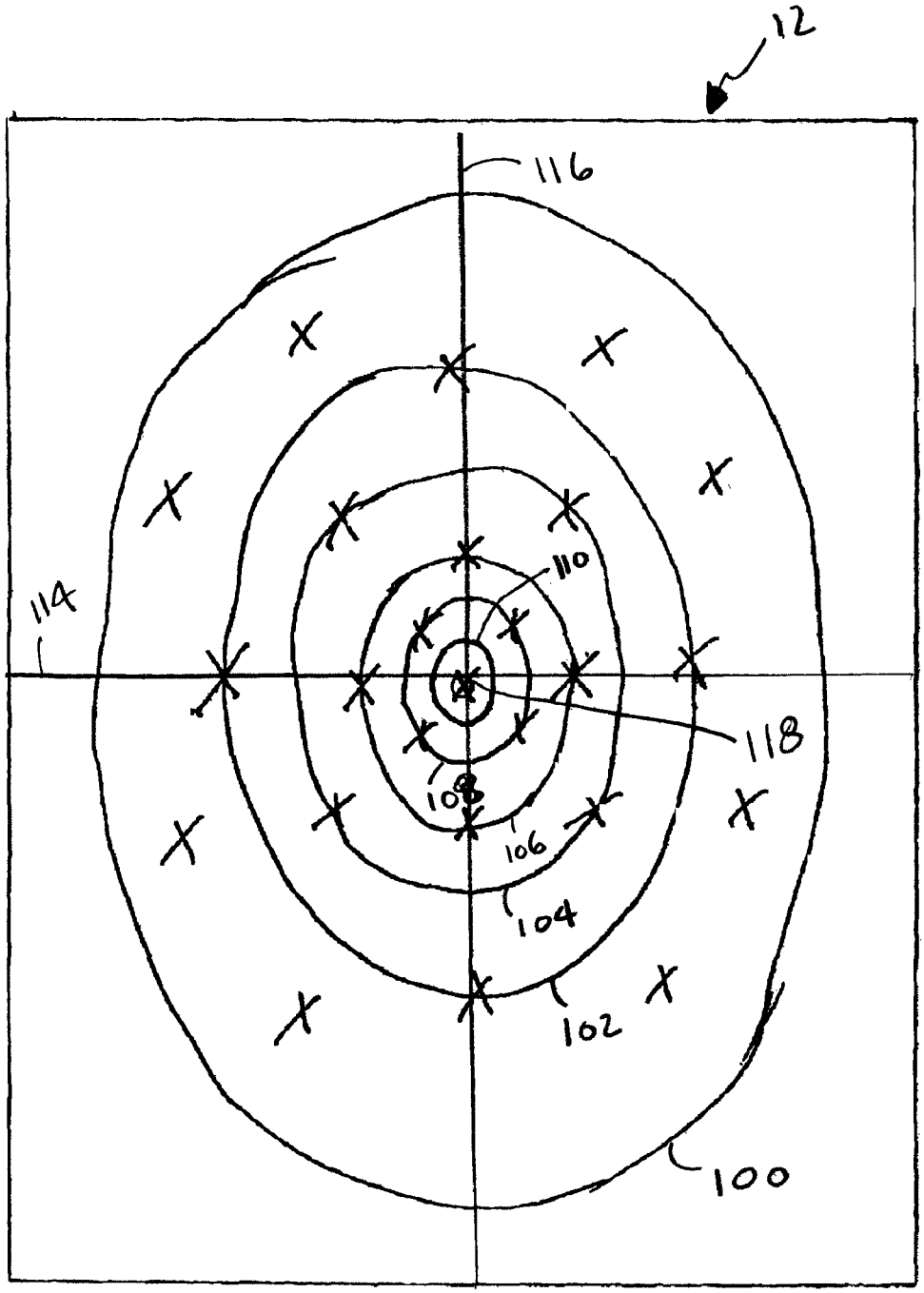
FIG. 2 is a plan view of an insulated glass unit, depicting iso-deflection lines and an exemplary placement of joiner pieces to provide a filled glass unit ("FGU")

Deflection increases in a lite as the distance from each side edge increases. Although shown in a somewhat schematic manner in FIG. 2, lines of iso-deflection 102, 104, 106, 108, 110 on a rectangular lite 12 are packed more closely towards the center of a lite, and will be generally elliptical about the minor and major axes 114, 116 of the lite. In a joiner placement pattern where the joiners are indicated by "X", the joiner placement is denser in the center of the FGU lite than toward the frame. The particular placement shows a placement of twenty-five joiners, built up from a central joiner 118, located at the center of the lite 12.

FIGS. 3*a* through 3*d* illustrate further aspects of joiner placement for a variety of rectangular FGUs, using one-inch diameter, 6 mm-thick joiners, adhered with a full coverage of 0.040 millimeter-thick bonding tape dots, used in the preferred embodiment. The minimum joiner arrangement, illustrated in FIG. 3*a*, is an FGU 302 with a single joiner 50, placed at the center of the FGU, where deflection is potentially the greatest. It is possible to use a single joiner in units sized up to 28¾" high (H1 in FIG. 3*a*) by 34 13/16" wide (W1 in FIG. 3*a*) in the preferred embodiment. As the width of the FGU increases (the height remaining constant), the number of joiners increase; however, as deflection decreases from the center to the edge of the lite, the density of joiners decreases toward the frame. The number of joiners in the preferred rectangular FGU embodiment is always odd, consisting of the center joiner 50 surrounded by an even-numbered and symmetrically placed number of additional joiners. When a minimum-joiner unit, that is, a unit requiring one joiner only, as FGU 302, expands in one-dimension only, the resulting joiner pattern is linear in the expanded dimension. By this, it is meant that the additional joiners are linearly arranged. For example, FGU 304 in FIG. 3*b*, shows a situation where the width W2 has increased from 34 13/16" to 53¾", but the height H1 has remained at 28¾". FGU 304 has three joiners, one being a joiner 50 and two being joiners 52. As the width W3 increases further, to 66⅞", the resulting FGU 306 of FIG. 3*c* has five joiners, consisting of one joiner 50, two joiners 52 and two joiners 54. As a final example, FIG. 3*d* shows an FGU 308 utilizing 7 joiners, consisting of one joiner 50, two joiners 52, two joiners 54 and two joiners 56. A typical size of FGU 308 would be 28¾ high (H1) by 89 11/16" wide (W4).

Figure 3:
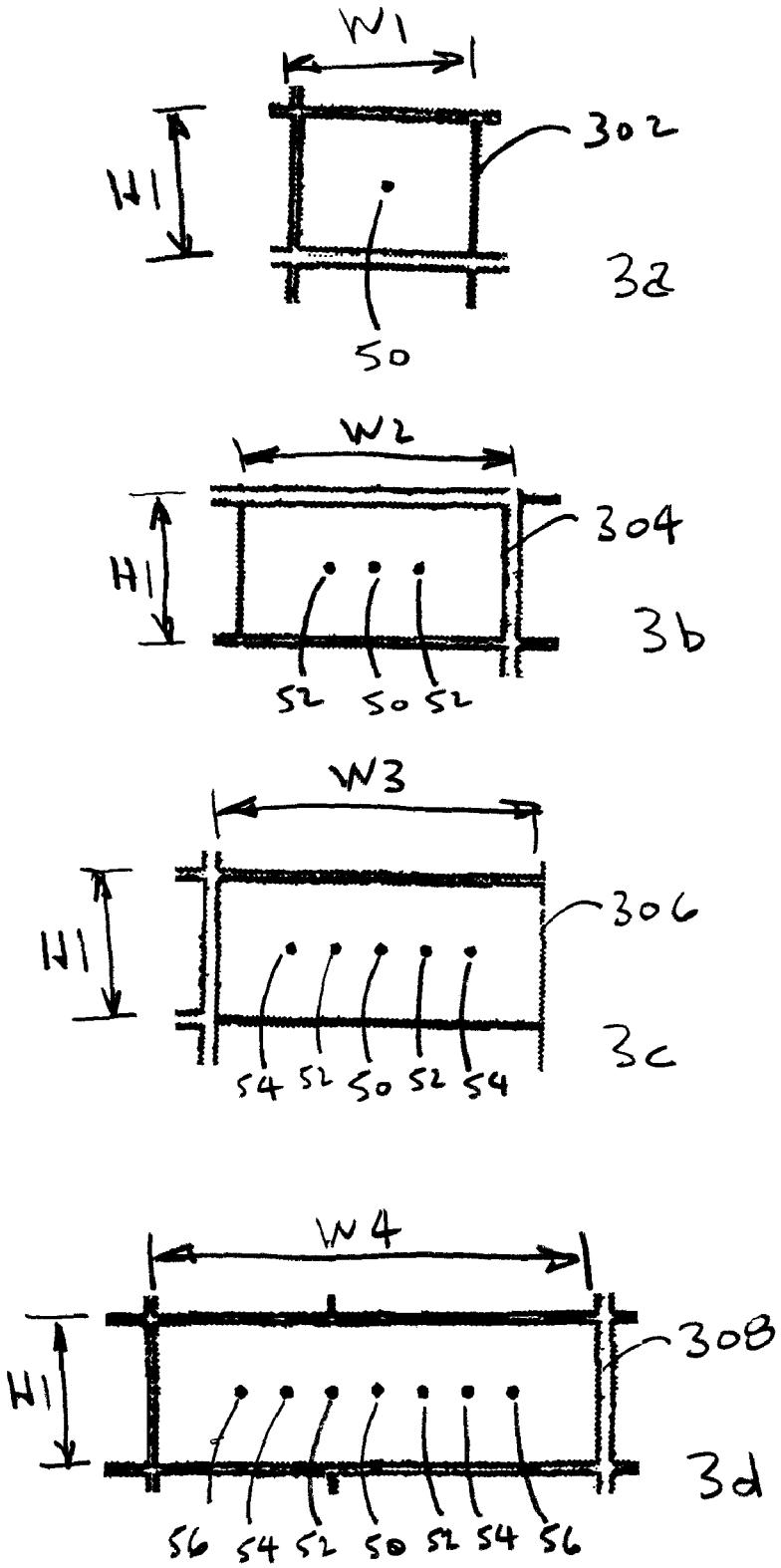
FIGS. 3*a* through 3*d* are elevation views of exemplary placements of joiner pieces in smaller FGUs where the height is constant, but the width is increasing.

While FIG. 3 provides insight into joiner placement in smaller FGUs, it becomes clear that larger FGUs will not be able to use only the linearly-placed joiners of FIG. 3. Indeed, as the overall size increases, and again with reference to FIG. 2, the joiners will be placed in a manner that will be symmetrical about the minor and major axes of the FGU. To disclose this more fully, reference is made now to FIGS. 4*a* through 4*c*, where FGUs 402, 404 and 406 are respectively shown. These FGUs 402, 404, 406 are shown placed on a side edge relative to the placement shown in FIG. 3, so these units have constant height H2 (in the preferred embodiment, nominally 85") and an increasing width (W1 or 34 13/16" in FGU 402, W2 or 53¾" in FGU 404 and W3 or 66⅞" in FGU 406). As a result, FGU 402 of FIG. 4*a* is shown with 11 joiners. These are central joiner 50 and two joiners 54, all aligned along the major axis, but intermediate to joiner 50 and either of joiners 54 is a joiner 52, which is one of eight joiners 52 symmetrically placed about the major and minor axes. In FGU 404 of FIG. 4*b*, the eleven joiners of FGU 402 are present, but four new, symmetrically placed joiners 58 are added, bringing the total to 15. Finally, in FIG. 4*c*, sixteen further joiners are added, to provide a total of thirty-one. These sixteen are two joiners 56, ten joiners 60 (five on each side of the major axis, with only the five on one side numbered) and four joiners 62.

Figure 4:
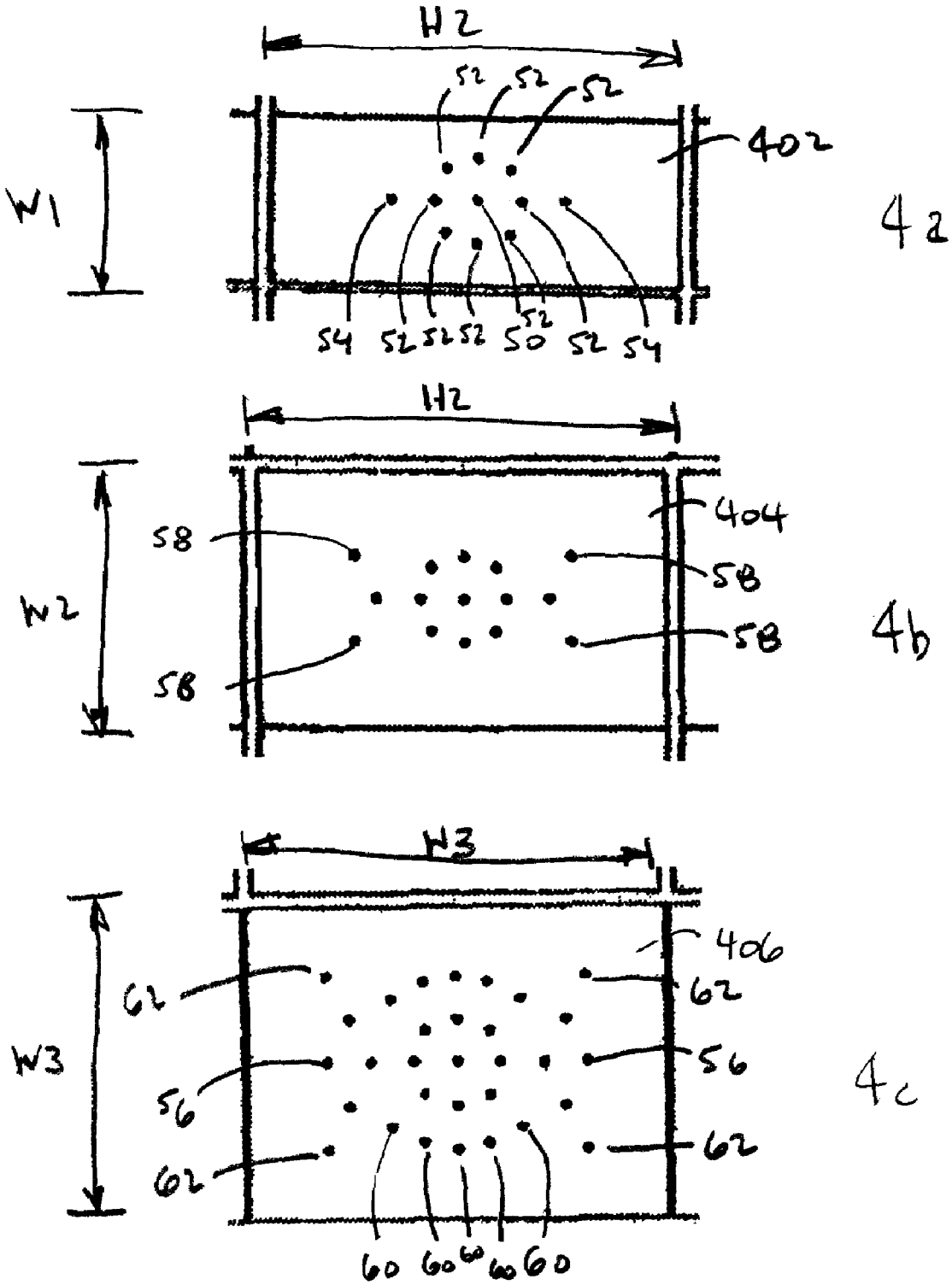
FIGS. 4*a* through 4*c* are elevation views of exemplary placements of joiner pieces in larger FGUs where the height is constant, but the width is increasing.
Figure 5:
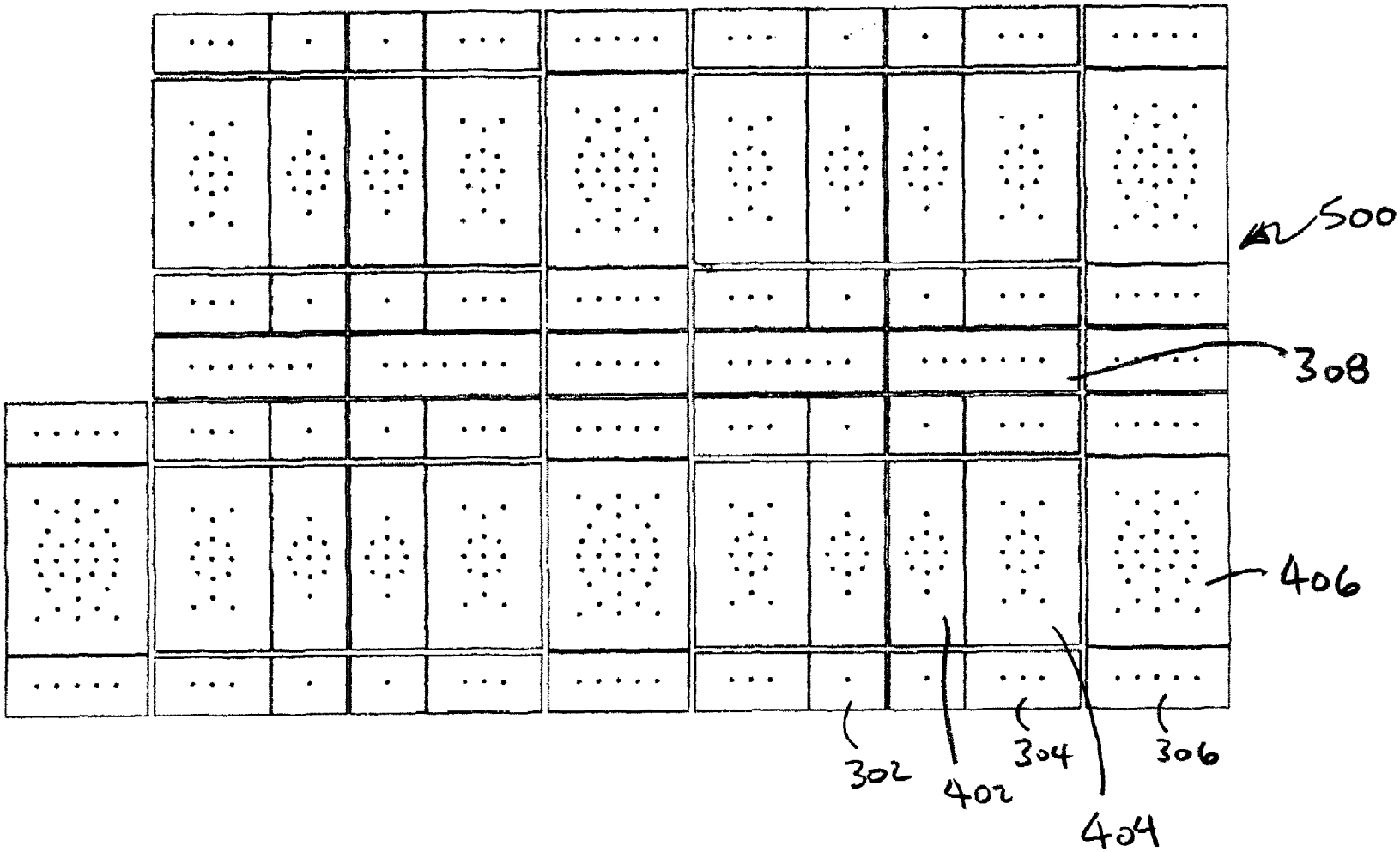
FIG. 5 is a elevation view of a space-filling arrangement of FGUs as illustrated in FIGS. 3 and 4.

Using the various FGU embodiments taught in FIGS. 3 and 4, a space-filling arrangement, such as would be useful in a wall, can be provided, by using known technology to frame the individual FGUs in a particular relationship. To demonstrate this, FIG. 5 shows one such embodiment 500 containing at least one of each of the various FGUs. This embodiment 500 has 16 FGUs of embodiment 302, 16 FGUs of embodiment 304, 10 FGUs of embodiment 306, 8 FGUs of embodiment 402, 8 FGUs of embodiment 404, and 5 FGUs of embodiment 406.

In the embodiments disclosed herein, the number of joiner elements is minimized to join the lites with surface pressure adequate for permanent adhesion and design integrity, while reducing the work required for assembly and allowing for the greatest freedom in design of the filler. The present embodiment incorporates the potential random distortions in the adhesive used to affix the joiners to the lites as an integral design element within the filler pattern.

In one exemplary method, a first pane of glass is provided. This pane of glass is placed in a horizontally supported position on a work surface, with a first surface of the first pane facing upwardly. A spacer frame, and particularly a spacer frame including a desiccant, is affixed around a periphery of the first surface, especially with a bead of an adhesive sealant. The upwardly facing first surface has at least one elongate joiner attached to it. Each of the elongate joiners extends substantially normal to the first surface to a height which slightly exceeds an intended gap to be provided between the first pane and a second pane to be joined with it. A design of filler material is arranging atop the first surface, and adjusted as necessary to provide a sufficiently tight fit. The elongate joiners and the spacer frame are prepared for sealing with a second pane of glass by applying a bead of adhesive sealant around a top surface of the spacer frame and providing an adhesive on an upwardly-extending end of each elongate joiner. The second pane, which has been carefully prepared and cleaned, is provided and is registered atop the spacer frame and each elongate joiner. By applying pressure to the second pane, it is sealingly secured to the spacer frame, forming a filled glass unit. If the filler elements have been properly sized and selected, the completed filled glass unit can be turned into a vertical position in which the filler elements are engagingly secured by the interior surfaces of the first and second panes and the at least one elongate joiner, after a suitable period for the adhesive materials to properly bond. The filler elements are not supported by or dependent from the spacer frame.

In respect to the safety and durability characteristics of an IGU, the FGU taught herein is configured to be usable as a replacement for a standard IGU in most uses, although it does so with partial loss of thermal insulating value and its greater weight may require greater load-bearing capacity in the supporting structure, depending on the size and number of the IGUs and the elements used for filler. The embodiment taught herein is structurally robust and was used as a replacement for standard, high-quality IGUs in a two-storey glass pedestrian bridge whose walls and ceiling are completely made up of IGUs that are glazed into an extruded aluminum frame. Several sample units, measuring 65"×84" unframed and 70"×92" framed, of the FGU have been positively evaluated in a testing laboratory for frost point per ASTM E576 after being subjected to cyclic load testing in general accordance with ASTM E1886, as described in more detail below.

An exemplary embodiment includes a method of bonding the lites together in a pattern which minimizes the number of bonding elements, prevents the unattached small components from falling, and causes the lites to act as a monolithic panel. It reduces deflections to prevent slippage of the components and damage to the lites and IGUs while permitting enough deflection to allow environmental and structural stresses to be absorbed without damage. Exemplary embodiments also include a method for determining the thickness of components to be used as filler. Although the embodiments taught here describe materials for bonding the lites and patterns for affixing the joiners, alternative embodiments use other materials and patterns having the requisite properties.

The exemplary embodiment describes a method for allowing the air gap between the lites of glass to be filled with small, loose components, without damaging the surfaces of the lites or the structural integrity of the FGU. In a device as known in the prior art, the components would sink toward the bottom of the glass when the lites deflect, ruining the design made by the arrangement of the filler components (and their relationship to designs applied to the lites) and impairing the structural integrity of the FGU. During their fall, some components would also lump into clusters where trapped between the lites by the action of the lites, which would damage the FGU by causing scratches and marring in the lites and eventually cracking in the lites. Deflection can occur for many causes, such as differential pressure or delay in load sharing or when the IGU is moved by equipment with suction cups, as the suction cups cause local deflections.

Designs and patterns and texturing can be applied to the surfaces of lites in an insulated glass unit (IGU) during manufacture of the glass by such methods as rolling, laminating, coating, or embedding of stranded or mesh wire or subsequently by such methods as sandblasting, fritting, application of decals, or silk screening. The exemplary embodiment is a method for creating three-dimensional patterns within an IGU, by filling the air space within the IGU with numerous, free-floating small components such as glass beads, glass lenses, glass disks, glass rectangles, and glass mirrors, resulting in a filled IGU (FGU). The embodiment may be used separately from or in conjunction with existing methods of patterning.

Preferred embodiments use IGUs, small glass components such as beads, lenses, mirror, and custom-cut shapes as filler, small bevel-edged glass disks as joiners to which the lites are adhered, and bonding tape such as VHB™ tape, commercially available through 3M, St. Paul, Minn., cut to the same shape as the joiner surfaces ("tape dots") to be adhered to the lites as the adhesive agent affixing the lites to the joiners. A typical filler density would be in the range of about 100 to about 135 pieces per square foot. Alternative embodiments use IGUs with three or more lites or non-glass filler components. Other alternative embodiments use an adhesive other than the VHB™ tape, so long as the adhesive agent or material is appropriately matched to the intended use of the unit, in respect to heating, cooling, and other environmental and structural stresses impacting the IGU. The VHB™ tape dots are preferred in the current design because of the material's ease in application and curing, its slight "give" when stretched and relaxed as lites deflect after installation so as to function as a pressure gasket, its prolonged elasticity when bonded, its UV resistance, and its clarity, which was aesthetically suitable to the filler design. In some designs, it may be preferred to use a bonding agent with color or other characteristics different than VHB™ tape.

The present embodiment is made with nominally ⅜"-thick clear heat-strengthened glass lites on both interior and the exterior, nominally 6 mm-thick clear bevel-edged glass discs of nominally 1" diameter used as joiners, an infill of nominally 6 mm-diameter glass beads, nominally ¼"-thick glass lenses, rectangles, and custom-cut shapes, miscellaneous small glass elements of a similar thickness, and 0.040-thick bonding tape dots bonding the joiners (on both sides) to the lites. Nominal dimensions are the standard measures used in ordering glass, but the embodiment taught here allows for standard manufacturing variance. For example, 6 mm elements used in the preferred embodiment have a manufacturing variance of approximately +/−0.2 mm, and the nominally ¼" glass components were, in fact, 0.223" and varied from 0.219" to 0.244". Alternative embodiments use different thicknesses of glass, different types of glass such as laminated glass or polarized glass, or glass with different transparencies or coloration. In theory glass could be manufactured to a higher tolerance or rejected if out of a narrow tolerance but there would be little cost-benefit as compared to using standard components, in respect to the present embodiment, which has been designed to accommodate standard glass for lites and filler elements. The choice of glass used in the lites and the filler elements is based on the installed FGU requirements and the aesthetics of the design. However, in addition to determining IGU requirements based on standard IGU-design considerations, the present embodiment must consider the weight of the filler. In addition, the dimensional relationships among material components used inside the unit, as relates to the thickness of the joiners, adhesive, and small elements filling the air gap, must be coordinated in a manner similar to that of the present embodiment. The lites in the preferred embodiment are sandblasted on the outboard lite, interior surface in a designed pattern prior to assembly of the FGU. These surfaces were chosen as the sandblasting surfaces to minimize cleaning difficulty in the assembled FGU. Alternative embodiments could use clear glass, fritted glass, silk screened glass, fritted glass, etched glass, or decaled glass, subject to the requirements of the installed FGU and the aesthetics of its design.

Figure 6:
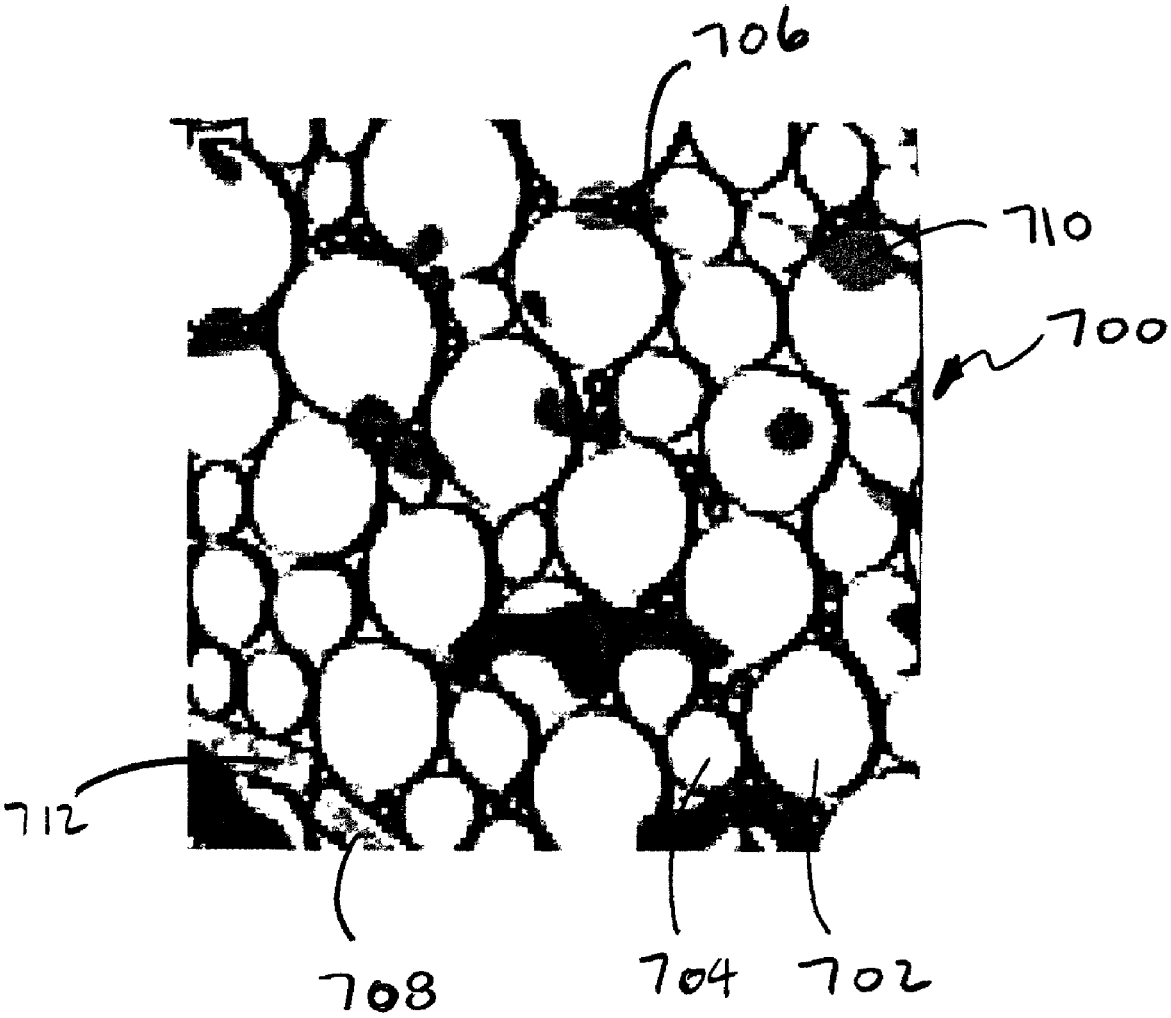
FIG. 6 is a photograph image of plan view through an FGU as taught herein, illustrating one embodiment of the filling materials.

FIG. 6 is a photographic illustration 700 of a portion of an FGU according to one or more of the above embodiments. In this illustration, a variety of both filling materials and surface treatments may be seen and appreciated. For example, there are at least two different sizes of glass disks 702, 704, a number of smaller glass beads 706 and a few elongate glass plates. Some darker areas 710 on the image are illustrative of sandblasting of the lite used as one of the faces of the FGU, and other darker areas 712 are illustrative of engraving and/or sandblasting of the individual filler materials. These two types of darker areas may be generally distinguished by the apparent "bleeding" of the darkness beyond filler material borders, in the case of area 710 and the "confinement" of the darker area 712 within a filler material piece. Not specifically shown, but certainly within the scope of the invention, is the use of colored filler materials. A notable fact about illustration 700 is the general inability to discern the joiner elements, particularly when there are dimensionally identical elements serving as a part of the filler material. The transparent nature of the preferred adhesives is responsible for this effect. While FIG. 6 is presented to illustrate the ability of an artist to exploit the capabilities provided by the invention, it is understood that the aesthetic value of the embodiments is not determinative of patentability.

The preferred embodiment allows for glass FGUs to be assembled in the same sizes as standard IGUs, quickly, and as substitutes for standard IGUs except in respect to their greater weight and reduced thermal-insulation value. Alternative embodiments would allow for the addition of a third lite within the FGU and the creation of an insulating airspace within the FGU, when thermal insulation is desired. Other alternative embodiments would allow for substitution of lites made from synthetic materials such as LEXAN®, where the application is suitable. Due to the insertion of the filler elements, an FGU does have a greater acoustic insulation value that a standard IGU of the same dimensions.

FGU construction begins with the partial pre-assembly of an IGU in a standard manner: In the preferred embodiment, the outboard lite is washed and dried, then immediately placed horizontal on a work table over a template onto which the positioning of the joiner elements is marked, so that the sandblasted surface (interior surface) is upward. The lite is rested above the work table surface on wood 2×4's rather than on the table surface itself, to prevent imperfections in the table surface from causing damage. The 2×4's are cut to be a few inches shorter than the lites, so that silicone can later be applied when sealing the FGU. They are spaced about a foot apart on the table surface stability and oriented so as to maximize stability based on the dimension of the unit but always parallel to a lite edge. A frame-like spacer, containing a desiccant, is then affixed to the edge of the lite with butyl. A temporary frame is then clamped around the exterior of the desiccant spacer to hold the spacer in place while the joiners and filler elements are laid down. In the case of the present embodiment, gray butyl was chosen for aesthetic reasons. Alternative embodiments could use other colors of butyl. Because desiccants cannot be exposed to air for more than 24 hours, it is necessary to complete assembly of and seal the FGU within 24 hours, a time constraint which can be further obviated by factory staffing or operational schedules. Because each FGU is custom-designed and hand-assembled, the exemplary embodiment was designed to minimize time of assembly while maximizing design flexibility.

Embodiments of the invention reduce assembly time by allowing for filler elements that do not required adhering to each other or to a lite, because the application of an adhering agent to numerous small elements would be time-consuming. It would also be unaesthetic in appearance and would make design changes difficult or impractical once an element is placed. Eliminating the need to adhere numerous small components also results in a great cost-savings in the assembly of the pattern made from the components, allows a greater range of components (which may, for example, have different reactions to the bonding agent in respect to adhesion, surface or texture stability, permeability, or discoloration), and is aesthetically superior in most embodiments. Bonding agents are laborious to apply to numerous components, typically time-sensitive in drying, difficult to apply in a controlled manner, typically require timely and extended application of pressure and/or light and/or heat to make the bond permanent, and can alter the appearance of the design by affecting the transparency and color of the lites and the components, or by partially liquefying and beading or puckering in use. In appearance, in allowing a greater freedom of design, and in allowing more time to build the 3-D filler design within the FGU, the use of unattached components is superior to a method using attached components. Alternative embodiments would allow for a small number of affixed filler elements, placed so as to enable a specific filler pattern, which would otherwise be impossible due to the geometry of the filler shapes or to enable exact precision in positioning of a filler element such as a logo or monogram or a perfectly parallel pair of stripes, which would otherwise be impossible due to variance in standard dimensions of the components or minor local shifting of the filler during assembly, shipping, and installation.

In the case of the exemplary embodiments, the surface of the inboard lite is sandblasted in a pattern; and 133 FGUs are subsequently glazed into an extruded aluminum frame to enclose the walkways. Each sandblasted surface pattern and each 3-D filler pattern is unique and the multitude of FGUs in their entirety make up a larger pattern. As a result, the lite must be properly oriented to assure that the patterns on the FGUs are aligned individually and as an assembly. Alternative embodiments would allow for use of repetitive patterning and standard designs, with or without minor customization. Alternative embodiments could be glazed into frames made of other materials such as wood, subject to the requirements of the installed FGU and the aesthetics of its design.

Normally, the lites in an IGU deflect under environmental and structural stress and the IGU in consequence pillows under pressure, as the air space is compressed and expands. In the exemplary embodiment, the pair of lites in the FGU are permanently connected together by one or more glass joiners. Joining the lites together in this way causes the FGU to function more monolithically, which reduces the range of variation in the gap space between the lites and prevents the filler elements from falling to the bottom of the FGU when it is moved from the horizontal. However, even though the lites do act monolithically, there is some pillowing due to such causes as the remaining air in the gap between the lites, delays in transfer of pressure, and manufacturing variations in component sizes. The number and arrangement of the joiners is determined by the size and shape of the FGU and to a lesser extent by aesthetic decisions made in the discretionary (non-thickness-related) dimensions of the joiner units themselves and the filler elements. The general rule of thumb in configuring joiner elements is parsimony, using the smallest size standard-sized joiner element that satisfies the requirements. In determining the requirements, first the joining resistance, to restrict pillowing of the lites in the assembled FGU to a maximum distance is calculated. The joining resistance is a determination, based on the total surface area to be joined between the lites in the FGU, for each side of the joiner. In the preferred embodiment the joining resistance was calculated to be approximately 63 pounds per square foot. The largest FGU is approximately 38 square feet in size, which yields a total joining resistance of 2394 pounds. The joiner used in the FGU is a standard glass piece with a surface area of 1-square inch and the bonding tape has a strength of 100 pounds per square inch. The total surface area is then divided equally among the number of joiners required, as determined by the deflection resistance pattern. In the preferred embodiment, this varied from one joiner to thirty-one joiners, varying by the dimensions of the FGU. The goal in making a deflection resistance pattern is to arrange the joiner elements so as to distribute deflection due to stress equally over the lites (and within the FGU frame, within the constraints of the geometry of the FGU shape). and to minimize the surface area bonded. Because joiners in the preferred embodiment used standard-sized joiner elements, the size of joiner used was the smallest size that satisfied the total joiner surface area requirement, resulting in a small total excess over the minimum total joiner surface area calculated. Alternative embodiments, which use larger filler elements or custom-size joiners for aesthetic purposes, will apply the same goals in determining joiner patterns.

In preparation for assembly, the joiner units for an FGU are prepared in advance. Joiners (and elements used as filler within the FGU) are rejected unless chip-free. Immediately prior to applying the bonding tape dots to the joiners, the joiners are cleaned with alcohol and dried with a lint-free cloth so as to be dust-free. Bonding tape dots are then peeled on one side and a dot is affixed to both of the flat surfaces of the joiner elements, so as to align with their flat surface areas and cover them.

After the outboard lite is placed horizontally and before the filler elements are inserted into the lite, the joiner elements are individually affixed to interior surface (see FIG. 1) of the outboard lite. This is done by peeling away the bonding tape liner on one side of the joiner and then affixing the joiner to interior surface of the outboard lite where the template is marked for a joiner. After a joiner is positioned, it is held in place with pressure from the heel of the hand for 20 seconds. This procedure is repeated until the joiner template pattern for the lite is completed.

Then the filler elements are arranged onto interior surface of the lite. The filler elements are placed to cover the surface and fill the spaces between the joiners densely to the full extent that the geometry of the shapes allows the surface to be covered, so that the remaining unfilled gaps do not allow shifting of the filler elements when the unit is made vertical other than for a very small amount of local settling. The filler elements are placed so as to lie flat (as they would if they were loose elements), creating a level surface over which to place the second lite. The filler elements are not jammed so tight as to wedge and cause some elements to protrude above the level surface, as this could permit shifting in the filler or damage to the assembled FGU by scratching, marring, or distending the lites. Gentle jiggling of the elements in an area by hand is recommended to smooth their distribution, while the filler is being assembled. The method described herein prevents shifting and falling elements from damaging or distending the FGU, so there is no otherwise no limitation in the arrangement of the filler elements, which is based on aesthetic concerns, other than filling the space densely enough to prevent the elements from shifting and falling and ruining the pattern when the FGU is made vertical. Minor shifting of elements is, however, likely and the filler pattern should be designed to accommodate this shifting. In the case of the present embodiment, certain rectilinear elements are also engraved with text and arranged in such a manner as to be read sequentially from element to element, so it is important to prevent shifting to preserve the readability of the text. The sequence for placing filler elements onto the lite is highly dependent on the particular pattern, but it is preferred to place the largest elements in an area first and then fill around it with smaller elements. In the preferred embodiment, the last elements placed are the smallest elements, the glass beads, which are also used to fill gaps once the overall surface is complete.

While most embodiments anticipate the creation of a considered and intentional pattern of the infill elements, the random placement of the infill elements to maintain the elements in place is within the expected scope, as the level of creativity is not a factor.

The thickness of the infill glass in the FGU is a critical dimension and is determined by the nominal "factory dimension" of the air gap between the lites after the lites are assembled and sealed in the FGU. In the case of the preferred embodiment, the desiccant strip is a nominal ¼, with a small variable addition resulting from the string butyl. The joiner glass is also a nominal 6 mm; however, the glass used for joiners is actually manufactured to be 6.5 mm (0.256"), which when joined to the two thicknesses of bonding tape (0.001"× 2=0.002") yields a thickness of 0.258". This thickness is designed to approximate but typically exceed the air gap (the desiccant strip plus string butyl), resulting in slight pressure on the glass at the point of joiner contact with the lites, which (a) potentially causes a slight bowing of the FGU lites, which bowing should be placed at the bottom of the installed unit; and (b) causes an increase in tension as joiners approach the edges of the glass and deflection is increasingly limited by the frame, which is the reason that joiners are spaced more densely toward the center of the glass and less densely toward the periphery. The preferred embodiment allows for the use of standard thickness filler elements and standard IGU components and frames, so an economic advantage obtains. Alternative embodiments are possible using differently sized but standard materials as well as embodiments using custom-sized materials. The finished glass beads and other elements used as unattached filler are sized to be slightly less thick than the air gap. For example, the preferred embodiment used nominal 6 mm glass beads and shapes cut from glass of a nominal ¼" thickness, both of which elements have manufactured variances whose upper limit is less than 0.24".

There are several reasons why it is critical to correlate dimensions. If the infill elements are not thick enough, the elements will fall to the bottom of the FGU when it is made vertical, when the lites deflect under stress (such as winds or temperature changes) and the air gap expands. In addition, when the lites recover and the momentarily enlarged "pillow" gap between the lites is closed, the infill elements can be trapped in a bunch, pinning elements in such a manner as to exceed the thickness of the air gap and causing the lites to distend outward and damaging the units. This process of deflection and recovery ("huffing and puffing") of the lites is repeated frequently, especially when the FGU functions as a window with a weather-exposed surface, which amplifies imperfections and impairs FGU life.

After the surface of the lite is covered with filler elements and the design completed, the temporary protective frame around the desiccant strip is removed and string butyl is hand-applied on the top surface of the desiccant strip. The inboard "closer" lite is washed and dried, the liner tape is removed from the bonding tape on all the joiner elements, the inboard lite is placed into position, and the FGU is temporarily clamped to press the butyl after which it is sealed with silicone. The assembled FGU can be moved from assembly work area, but it should remain horizontal while being transferred and should again be placed flat on a horizontal surface over 2×4's, during the time that the joiners are bonding to the lites. A weight of 40 pounds is placed over every third joiner for 72 hours to allow the bonding tape to bond to the lites. The weight should be surfaced with a material that will not damage the lite. In the preferred embodiment, water-filled plastic jugs were used as weights. In alternative embodiments, using adhesives other than 3M™ VHB™ tape, the method of making the bonds permanent may be different, based on the product specifications. For example, in embodiments using LOCTITE® (Henkel, Avon, Ohio), bonds must be set with a heat light.

Two tests were performed on three exemplary FGU units as described below. Each of the selected FGUs passed both tests.

In the first test, an FGU measuring 64⅝" by 85" was manufactured according to the method set out above. The FGU comprised an outboard lite, an inboard lite, thirty-one joiner discs and infill material. The outboard lite was ⅜" thick, clear heat-strengthened glass, with a sandblasted pattern. The inboard lite was also ⅜" thick, clear heat-strengthened glass, but is not sandblasted. The joiner discs are ¼" thick with 0.040" VHB on each side thereof. The infill material comprised discs, engraved shapes and glass beads, all having a thickness of ¼".

The FGU was evaluated for a frost point using ASTM Method E576. This test involves contacting the outboard lite with a freezing canister maintained at a temperature of about −40 F, which is also conveniently −40 C, during which contact any condensation formed within the FGU is observed. The pre-glazed unit assembly is mounted in a test frame and exposed to an infra-red ("IR") heat source, directed at the outboard lite. The IR source is positioned so that the temperature of the exterior metal around the FGU is 160 F, +/−5. Simultaneous to the IR exposure, a cyclic structural load of 63 lbs/ft$^2$ is applied for 9000 pressure cycles, as described in Table 1"Cyclic Static Pressure Differential Loading" of ASTM Method E1886. Deflection transducers are placed on the FGU to measure deflection of the FGU. Upon completing the pressure loading test, the frost point test is repeated, again looking to observe condensation inside the FGU. The FGU is submersed in a water tank for 18 hours, followed by a further frost point test to determine whether any seal penetration has occurred.

In the second test, an FGU comprising identical components is tested in a manner similar to that of the first test, but the test terminates after the frost point test following the cyclic structural loading test. In other words, the water submersion and subsequent frost point tests are omitted. Again, the sample FGUs manufactured according to the method taught herein pass the test.

What is claimed is:

1. A method of fabricating a filled insulated glass unit, comprising the steps of:

providing a first lite of glass;

placing the first lite in a horizontally supported position, a first surface of the first lite facing upwardly;

affixing a spacer frame around a periphery of the first surface;

affixing a first end of a first joiner element to a center of the first surface, the first joiner element extending substantially normal to the first surface and having an upward height that slightly exceeds an intended gap to be formed;

building up a filler design atop the first surface by arranging a plurality of infill elements within the spacer frame;

applying a bead of adhesive sealant around a top surface of the spacer frame;

providing an adhesive on an upwardly-extending second end of the first joiner element;

registering a second lite of glass atop the spacer frame and the first joiner element, a first surface of the second lite in facing relationship to the first surface of the first lite; and applying pressure to the second lite to sealingly secure it to the spacer frame, forming a filled glass unit with the intended gap between the respective first surfaces;

wherein the infill elements are sized and selected to be maintained in the filler design in the gap when the filled glass unit is turned to a vertical position.

2. The method of claim 1, wherein:

the step of affixing the spacer frame is achieved using a bead of an adhesive sealant.

3. The method of claim 1, further comprising the step of:

removing atmospheric moisture from the filled glass unit by inserting a desiccant material into the unit before the second lite is sealed to the spacer frame.

4. The method of claim 1, further comprising the step of:

affixing at least one set of at least two second joiner elements to the first surface of the first lite, each second joiner element of each set arranged symmetrically relative to the first joiner element.

5. The method of claim 4, wherein:

the first and second joiner element is a cylindrical disc.

6. The method of claim 4, wherein:

each second joiner element is affixed to the first surface in spaced-apart relationship relative to the remaining joiner elements.

7. An ornamental filled insulated glass unit, comprising:

a first and a second lite of glass, the respective lites being of substantially identical height and width;

a continuous spacer frame, affixed around a periphery of each of the lites to maintain the lites in fixed spaced-apart relationship, providing a gap with a predetermined thickness between the facing inner surfaces of the lites;

a first joiner element, having a thickness slightly larger than the thickness of the gap, positioned in the gap and contacting the respective inner surfaces of the lites at a center point of each; and a plurality of infill elements arranged around the first joiner element in the gap to substantially fill the gap, each of the infill elements having a thickness slightly less than the gap thickness.

8. The unit of claim 7, further comprising:

a plurality of second joiner elements, arranged in at least one set of symmetrical positions about the first joiner element, each of the second joiner elements having a thickness slightly larger than the gap thickness, positioned in the gap and contacting the respective inner surfaces of the lites.

9. The unit of claim 8, wherein:

each of the first and second joiner elements are affixed to the inner surfaces of the first and second lites by a layer of double-sided bonding tape.

10. The device of claim 8, wherein:

the first and second joiner element is a cylindrical disc.

11. The device of claim 8, wherein:

each first and second joiner element is in spaced-apart relationship relative to the remaining joiner elements.

12. The unit of claim 7, wherein:

the first and second joiner elements are visually indistinguishable from the infill elements.

13. The unit of claim 7, wherein:

at least one of the lites comprises laminated glass.

14. An ornamental display, comprising:

a plurality of the ornamental filled insulated glass units of claim 7; and a framing structure maintaining the filled insulated glass units in predetermined spatial arrangement.

* * * * *